US006726033B2

(12) United States Patent
Sparkowski et al.

(10) Patent No.: US 6,726,033 B2
(45) Date of Patent: Apr. 27, 2004

(54) CLOTHES HANGING AND BAGGING RACK

(75) Inventors: Robert P. Sparkowski, Schaumburg, IL (US); Vincent Gioia, Westmont, IL (US)

(73) Assignee: Chicago Display Marketing Corporation, Melrose Park, IL (US)

( * ) Notice: Subject to any disclaimer, the term of this patent is extended or adjusted under 35 U.S.C. 154(b) by 143 days.

(21) Appl. No.: 10/145,559

(22) Filed: May 14, 2002

(65) Prior Publication Data

US 2003/0213761 A1 Nov. 20, 2003

(51) Int. Cl.[7] ..... A47F 7/24

(52) U.S. Cl. ..... 211/85.3; 53/256; 211/196; 211/205; 211/207

(58) Field of Search ..... 211/85.3, 196, 211/205, 204, 175, 207, 119.001, 107, 27, 189, 85.15, 85.17; 248/158, 95, 161, 157, 153, 150, 149, 346.5, 346.01; 53/256, 168, 202

(56) References Cited

U.S. PATENT DOCUMENTS

| | | | | | |
|---|---|---|---|---|---|
| 1,710,867 | A | * | 4/1929 | Eckburg | 53/241 |
| 2,057,406 | A | * | 10/1936 | Willson | 248/411 |
| 2,069,690 | A | * | 2/1937 | Wells et al. | 53/256 |
| 2,136,703 | A | | 11/1938 | Miller | |
| 2,385,996 | A | * | 10/1945 | Kohl | 53/256 |
| 2,554,907 | A | * | 5/1951 | Hinnant | 53/256 |
| 2,604,214 | A | * | 7/1952 | Fussell | 211/207 |
| 2,609,983 | A | * | 9/1952 | Denton | 53/242 |
| 2,654,484 | A | * | 10/1953 | Win et al. | 211/1.3 |
| 2,747,734 | A | * | 5/1956 | Darnell, Jr. | 209/173 |
| 2,810,598 | A | | 10/1957 | Lief | |
| 2,861,408 | A | * | 11/1958 | Schultz | 53/256 |
| 2,882,666 | A | * | 4/1959 | Cochrane | 53/256 |
| 2,960,236 | A | | 11/1960 | Prenveille | |
| 2,995,000 | A | | 8/1961 | Bader | |
| 3,023,558 | A | * | 3/1962 | Mitchell | 53/241 |
| 3,023,912 | A | * | 3/1962 | Sebastian | 211/196 |
| 3,110,506 | A | * | 11/1963 | O'Brien | 211/105.6 |
| 3,210,909 | A | | 10/1965 | Cochrane | |
| 3,287,881 | A | * | 11/1966 | Jelling et al. | 53/256 |
| 3,955,787 | A | * | 5/1976 | Brown | 248/159 |
| 3,982,377 | A | | 9/1976 | Vanderpool | |
| 4,082,596 | A | | 4/1978 | Vanderpool | |
| 4,091,598 | A | | 5/1978 | Vulcano et al. | |
| 4,094,128 | A | | 6/1978 | Vulcano et al. | |
| 4,104,972 | A | | 8/1978 | Baublitz | |
| 4,201,975 | A | * | 5/1980 | Marcus | 340/908 |
| 4,230,051 | A | * | 10/1980 | Mays | 108/55.1 |
| 4,233,797 | A | | 11/1980 | Schwarz | |
| 4,725,027 | A | * | 2/1988 | Bekanich | 248/125 |
| 4,873,812 | A | | 10/1989 | Pavel | |
| 4,890,749 | A | | 1/1990 | Walter | |
| 4,895,261 | A | * | 1/1990 | Yacobian | 211/196 |
| 5,411,035 | A | * | 5/1995 | Stone | |
| 5,601,193 | A | * | 2/1997 | Santoya | 211/11 |
| D391,706 | S | * | 3/1998 | Malcolm | D32/35 |
| 5,833,081 | A | * | 11/1998 | Smith | 211/86.01 |
| 5,887,407 | A | | 3/1999 | Watkins | |

FOREIGN PATENT DOCUMENTS

| | | |
|---|---|---|
| JP | 5213316 A | 8/1993 |

* cited by examiner

*Primary Examiner*—Jennifer E. Novosad
(74) *Attorney, Agent, or Firm*—Vedder Price Kaufman & Kammholz

(57) ABSTRACT

An apparatus having a base, an extendable bagging pole having a foot pedal, coupled to a front edge of the base and an adjustable hanging rack coupled to the back edge of the base. The bagging pole has a bagging pole upper tube with a C-shaped clip disposed thereon and a bagging pole lower cylinder. The hanging rack has a hanging rack upper tube and a hanging rack lower cylinder, with a crossbar disposed on the hanging rack upper tube. The bagging pole is extendable to first operative position and retractable to a second operative position. After bagging the clothing item and depressing the foot pedal to retract the bagging pole from the first operative position to the second operative position, the clothing item may then be hung on crossbar of the hanging rack.

17 Claims, 3 Drawing Sheets

CLOTHES HANGING AND BAGGING RACK

FIELD OF THE INVENTION

The present invention relates to the field of display racks, more specifically to a clothes bagging and hanging rack.

BACKGROUND OF THE INVENTION

Within a retail store, customers often purchase clothing items on hangers. For example, typically when a customer purchases a suit, sport coat, winter coat, etc., the item is left on the hanger to be carried out of the store, not only making it easier for the customer to carry the item, but also maintaining the integrity of the clothing item.

To protect the clothing item, typically a retail store will provide a protective bag to be placed over the clothing item. Some retail stores may provide a protective suit bag having a zipper front, but often times a plastic bag, bearing the store's logo, is placed over the clothing item, so the customer can safely transport the newly purchased clothing item out of the store.

The protective bag typically consists of a long bag having an open bottom end and a small opening at the top end for a hanger hook to extend therethrough. Typically, these bags are disposed on a roll, wherein a store clerk unrolls and separates, via a perforated edge, a single bag from the roll. The clerk must then guide the clothing item through the opened bottom end of the bag, such that the hanger hook emerges through the small opening at the top of the bag.

Properly inserting the clothing item within the protective bag is difficult due to several complications. One disadvantage is that it is not uncommon for the plastic bag to be subject to static cling, making it difficult to get the clothing item inside the bag. Another disadvantage is that bagging the clothing item may be time consuming, causing the customer, and other subsequent customers, to wait for the clerk to place the bag over the clothing item.

One attempted solution to overcome the disadvantages of placing the protective bag over the clothing item is to hang the item on a rack and pull the bag over both the clothing item and the rack. This technique allows the clerk to quickly bag the clothing item. Although, when removing the bagged clothing item, the clerk must then lift the bagged clothing item up and over the rack, which may provide further complications due to the possible length of the clothing item, the height of the clerk, and the ability of the clerk to lift the clothing items safely over the bar.

Therefore, another attempted solution is a retractable rack, wherein the rack holds the clothing item while it is being bagged. Once the bag has been properly secured over the clothing item, the rack is retracted. For example, one such rack embodiment provides for a foot pedal, whereupon the clerk may step on the foot pedal, causing the rack to retract. The clerk may then simply lift the bag over a bottom portion of the rack and present the bagged clothing item to the customer.

The single retractable rack has several disadvantages for the clerk, in that it may prove to be unstable if the clerk bags a plurality of clothing items or a single heavy clothing item, such as a thick winter coat. Another disadvantage is that the single retractable rack requires the clerk to find a place to hang other clothing items, bagged or un-bagged. It is not uncommon for a clerk to hold clothing items behind the counter for a customer, for convenience, such that the customer does not have to carry the items while further shopping. Also, a clerk is often engaged with several customers at once, and when there are multiple clerks, a need exists for a place to safely store clothing items, bagged and un-bagged.

Therefore, there exists a need for a clothes bagging and hanging rack which allows for a stable retractable bagging rack as well as a hanging rack capable of holding a plurality of clothing items disposed on hangers.

SUMMARY OF THE INVENTION

The present invention is directed to an improved clothes bagging and hanging rack. Coupled to a front edge of a base is a bagging rack having both a bagging rack lower cylinder and a bagging rack upper tube. The bagging rack upper tube is extendable relative to the bagging rack lower cylinder to a first operative position and retractable to a second operative position. In the first operative position, the bagging rack upper tube extends to a maximum position relative to the bagging rack lower cylinder. In the second operative position, the bagging rack upper tube downwardly retracts within the bagging rack lower cylinder.

The bagging rack also has a clip having a C-shaped hook disposed on top of the bagging rack upper tube. The bagging rack further has a foot pedal coupled to the front of the base. The bagging rack may be retracted to the second operative position, from the first operative position, through depressing the foot pedal. Also, the bagging rack may be extended from the second operative position to the first operative position by a user lifting the bagging rack upper tube to the maximum position relative to the bagging rack lower cylinder, where it is locked in place by an internal latch coupled to the foot pedal.

The present invention also has a hanging rack coupled to the back edge of the base. The hanging rack has a hanging rack lower cylinder and a hanging rack upper tube wherein the position of the hanging rack upper tube relative to the hanging rack lower cylinder is adjustable. The hanging rack includes a load spring, having an outer tab, disposed within the hanging rack upper tube, wherein the hanging rack upper tube is disposed relative to the hanging rack lower cylinder through the outer tab of the load spring engaging one of a plurality of apertures disposed on the hanging rack lower cylinder.

A crossbar is disposed on the hanging rack, extending perpendicularly from the hanging rack, and parallel with the base. The cross bar has a first end disposed in the direction of the bagging rack and a second end disposed away from the bagging rack. The clothes bagging and hanging rack further has a box holding wire coupled to the base disposed substantially between the bagging rack and the hanging rack.

DETAILED DESCRIPTION OF THE DRAWINGS

Figure 1:
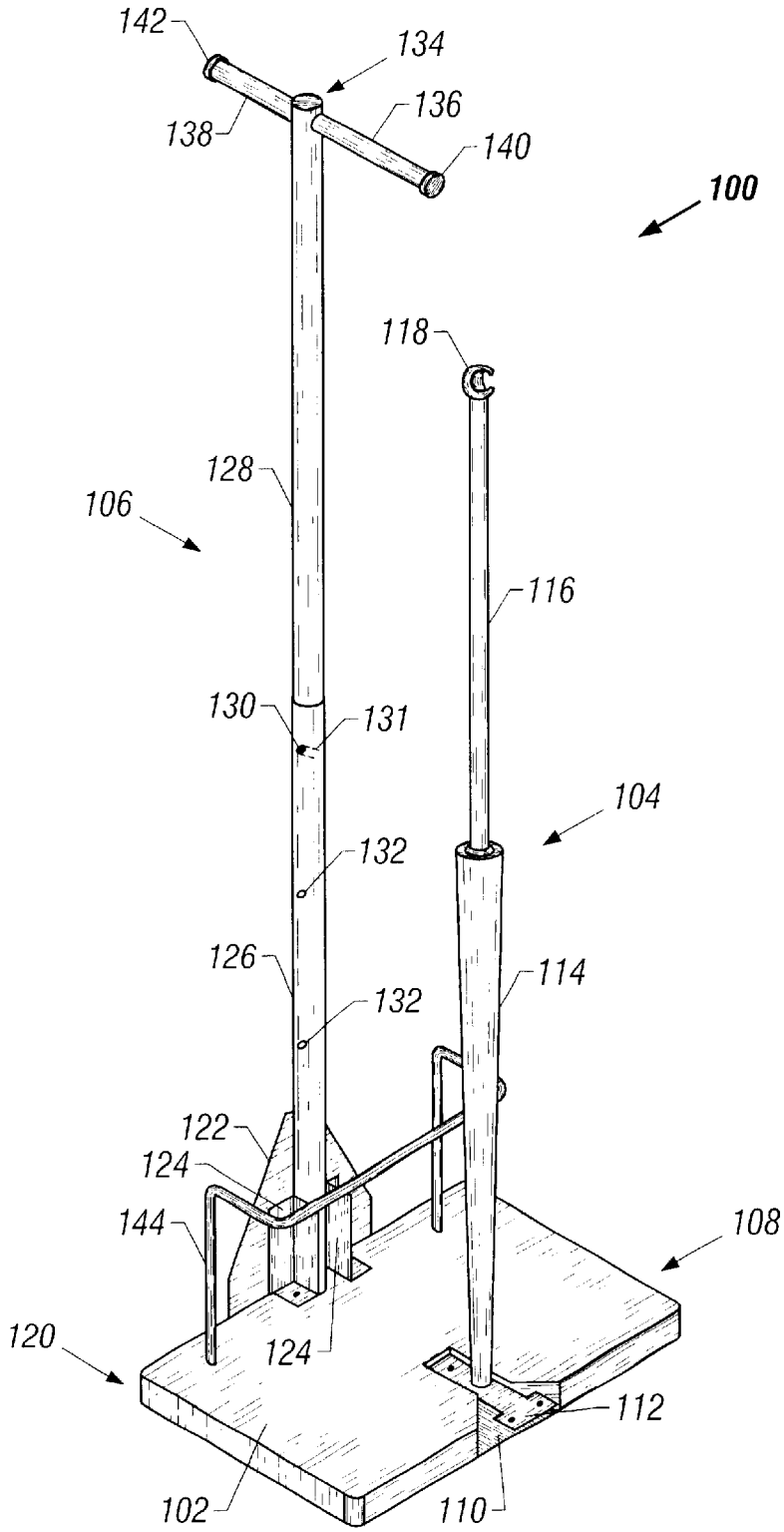
FIG. 1 illustrates a perspective view of a clothes bagging and hanging rack, in accordance with an embodiment of the present invention, with the bagging rack in the first operative position.

The present invention provides for a clothes bagging and hanging rack allowing a user to easily bag, remove, and store a plurality of clothing items. FIG. 1 illustrates a perspective view of the clothes bagging and hanging rack 100, in accordance with one embodiment of the present invention. The clothes bagging and hanging rack 100 has a base 102 having a bagging rack 104 and a hanging rack 106 attached thereon.

The bagging rack 104, such as part number CM74733 manufactured by Econoco Corp. of 300 Karin Lane, Hicksville, N.Y. 11801, is attached to a front edge 108 of the base 102. In the preferred embodiment, the bagging rack 104 is disposed in a groove 110 in the front edge 108. A foot pedal 112, coupled to the bagging rack 104, is disposed within the groove 110.

Figure 2:
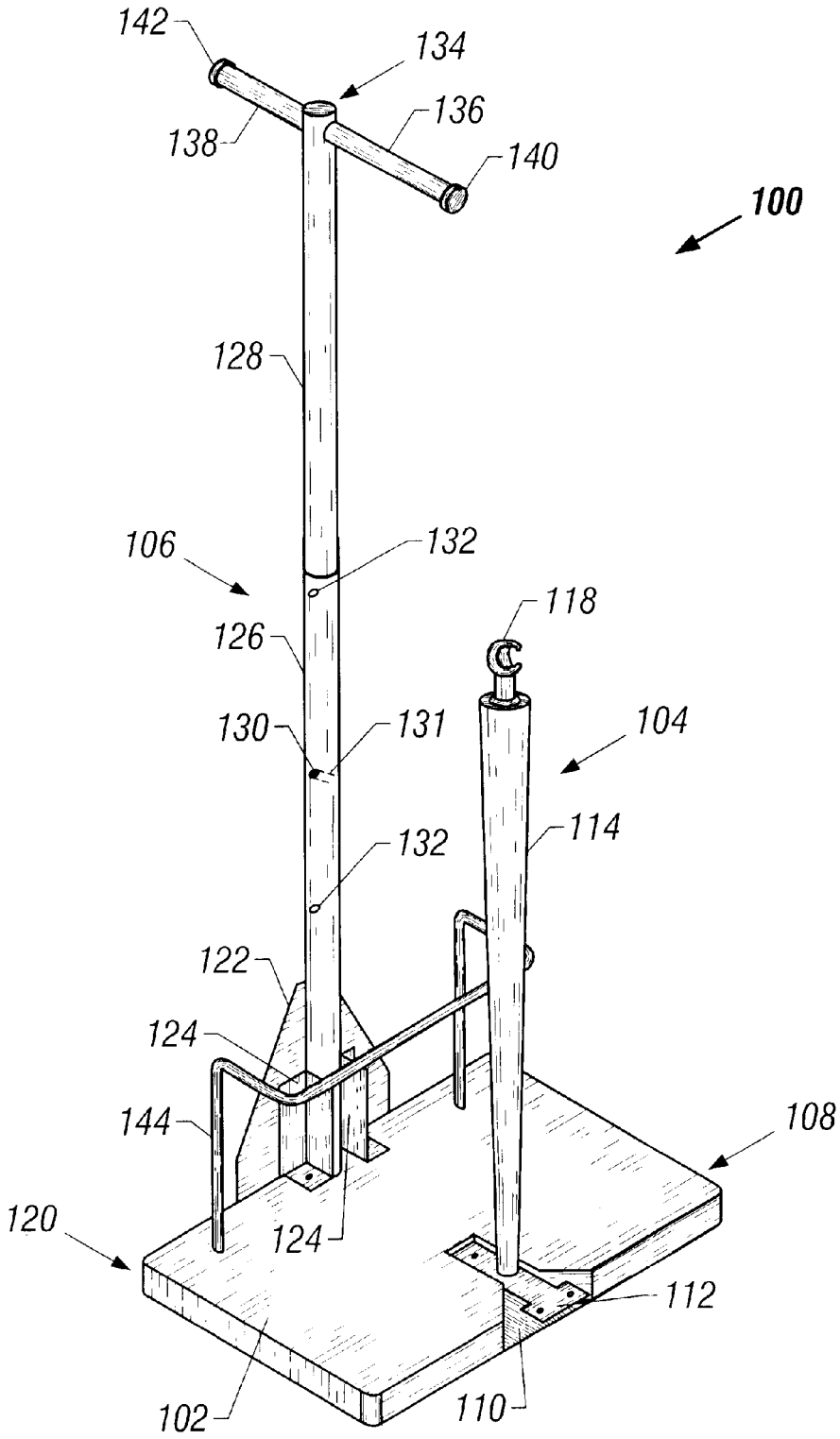
FIG. 2 illustrates a perspective view of the clothes bagging and hanging rack of FIG. 1, where the bagging rack is in the second operative position.

The bagging rack 104 also has a bagging rack lower cylinder 114 and a bagging rack upper tube 116. The bagging rack upper tube 116 can be disposed either in a first operative position, or a second operative position. In the first operative position, the bagging rack upper tube 116 fully extends to a maximum position relative to the bagging rack lower cylinder 114, as illustrated in FIG. 1, and in the second operative position, the bagging rack upper tube 116 retracts to a minimum position relative to the bagging rack lower cylinder 114, i.e. within the bagging rack lower cylinder 114, as illustrated in FIG. 2.

A clip 118 is disposed on top of the bagging rack upper tube 116. The clip 118 is a C-shaped hook for receiving and holding a clothes hanger. Moreover, the bagging rack 104 may be retracted from the first operative position to the second operative position by a user depressing the foot pedal 112, causing the bagging rack upper tube 116 to retract into the bagging rack lower cylinder 114.

The hanging rack 106 is attached to a back edge 120 of the base 102. In the preferred embodiment, the hanging rack 106 is attached to the base 102 using a bracket plate 122 having two side plates 124. Also, not visible in FIG. 1, the bracket plate 122 extends under the base 102, while the side plates 124 extend over the base 102. The plates, 122 and 124, secure the hanging rack 106 the base 102 through the bottom of the bracket plate 124 into the bottom of the base 102, and through the side plates 124 into the top of the base 102.

In addition to the bracket plate 122 and the side plates 124, the hanging rack 106 is further composed of a hanging rack lower cylinder 126 and a hanging rack upper tube 128. The bracket plate 122 and the side plates 124 are affixed to the lower end of the hanging rack lower cylinder 126.

A load spring (not shown), having an outer tab 130, is disposed within the hanging rack upper tube 128. The outer tab 130 extends through one of a plurality of apertures 132 on the hanging rack lower cylinder 126, thereby securing the position of the hanging rack upper tube 128 relative to the hanging rack lower cylinder 126.

The hanging rack 106 is adjustable to a plurality of different heights, based on which of the plurality of apertures 132, the tab portion 130 of the load spring 131 engages. As illustrated in FIG. 1, the hanging rack 106 is disposed at a maximum position with the tab portion 130 engaging the top-most aperture 132. The hanging rack 106 is adjustable by a user pushing the tab portion 130 inward and adjusting, upward or downward, the hanging rack upper tube 128 relative to the hanging rack lower cylinder 126. When the tab portion 130 of the load spring 131 encounters the next aperture 132, the tab portion 130 will spring outward, engaging the aperture 132 and disposing the hanging rack upper tube 128 relative to the hanging rack lower cylinder 126 in a new position, such as the middle position illustrated in FIG. 2.

FIG. 1 illustrates three apertures 132 on the hanging rack lower cylinder 126, but this is for illustration purposes only, as the number of apertures 132, thus the number of adjustable heights for the hanging rack 106 is not herein so limited.

Further disposed on the hanging rack upper tube 128 is a crossbar 134, the crossbar 134 having a first end 136 and a second end 138. The first end 136 of the crossbar 134 extends towards the bagging rack 104 and the second end 138 extends away from the bagging rack 104. Moreover, the crossbar 134 has a first disc 140 disposed at the first end 136 and a second disc 142 disposed at the second end 138. The first disc 140 and the second disc 142 prevent any clothing items hung on the crossbar 134 from sliding off the first end 136 or the second end 138.

Also illustrated in FIG. 1, a box holding wire 144 is coupled to the base 102, disposed substantially between the bagging rack 104 and the hanging rack 106. The box holding wire 144 is a rigid tubular wire extending upward from the base 102, at a position substantially parallel with the hanging rack, extending towards the bagging rack parallel with the base, and extending between the bagging rack and the hanging rack, parallel with the base 102.

The box holding wire 144 allows a user to place a box (not shown) on the base 102, wherein the box may contain a plurality of a hanging bags. A user may then quickly remove a hanging bag and slip the hanging bag over a clothing item disposed on the bagging rack 104. Typically, the hanging bags are on a roll, wherein each bag is separated by a perforated edge. The box holding wire allows the user to quickly remove a hanging bag from the box, without the box shifting its position on base 102.

Illustrated in FIG. 2, the height of the hanging rack 106 is adjusted and the bagging rack 104 is in the second operative position. Upon the depression of the foot pedal 112, the bagging rack upper tube (not shown) retracts into the bagging rack lower cylinder 114, leaving only the C-shaped clip 118 visible. To return the bagging rack to the first operative position, as illustrated in FIG. 1, a user may simply lift the bagging rack upper tube until it locks into place, in the maximum position.

Also illustrated in FIG. 2, the height of the hanging rack 106 is adjusted. The outer tab 130 of the load spring 131 engages the middle aperture 132, thereby disposing the hanging rack upper tube 128 relative to the hanging rack lower cylinder 126.

Figure 3:
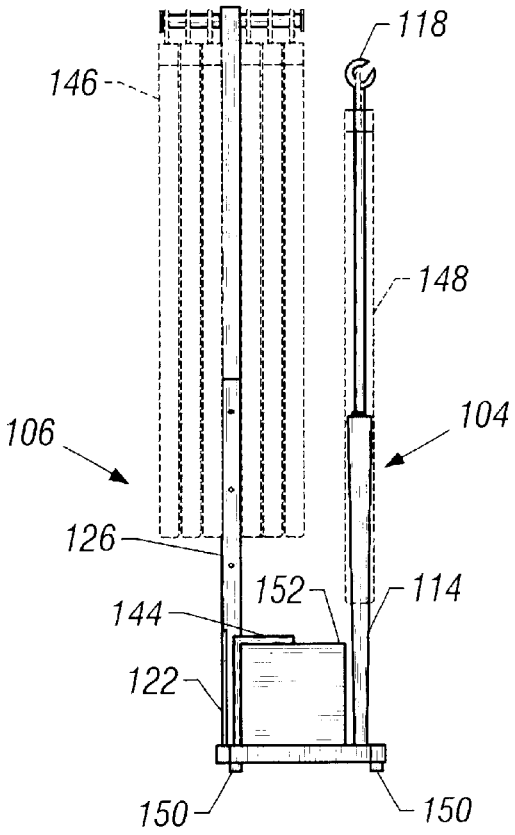
FIG. 3 illustrates a side view of the clothes bagging and hanging rack of FIG. 1 having a plurality of clothing items disposed thereon, wherein the bagging rack is in the first operative position.

FIG. 3 illustrates a side view of the present invention, having a plurality of clothing items, 146 and 148, disposed thereon. In FIG. 3, the bagging rack 104 is in the first operative position, and a bagged clothing item 148 is illustrated thereon. Also, the hanging rack contains a plurality of bagged clothing items 146, having already been bagged on the bagging rack 104, removed, and hung on the hanging rack 106.

Also illustrated in FIG. 3 are a plurality of heavy bumpers 150 disposed on the underside of the base 102. These heavy bumpers 150, (two not visible) provide for the stability of the base 102 as the bagging rack 104 and hanging rack 106 are used. As clothing items 146 are hung on the hanging rack 106 and bagged on the bagging rack 104, this can provide a large degree of shifting in weight. The heavy bumpers 150 provide the stability to prevent the apparatus 100 from falling or tipping over. FIG. 3 also shows a box 152 disposed on the base, secured in place under the box holding wire 144.

Figure 4:
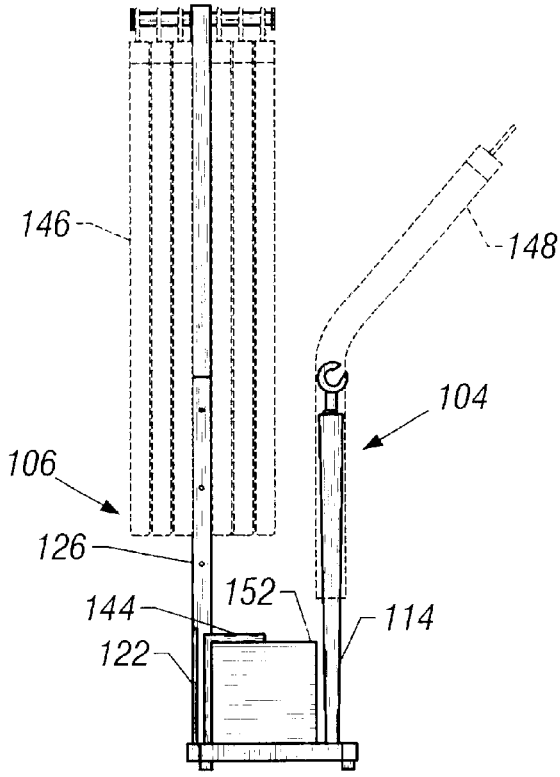
FIG. 4 illustrates a side view of the clothes bagging and hanging rack of FIG. 1 having a plurality of clothing items disposed on the hanging rack, wherein the bagging rack is in the second operative position, illustrating the removal of a bagged clothing item from the bagging rack.

Similar to FIG. 3, FIG. 4 illustrates the present invention having a plurality of clothing items, 146 and 148, disposed thereon. The bagging rack 104 in FIG. 4 is in the second operative position, whereupon a user has depressed the foot pedal (not visible). Once the bagging rack upper tube (not visible) has been retracted, the bagged clothing item 146 can be easily removed from the bagging rack 104, as the bag covering the bagged clothing item must only be pulled over the bagging rack lower cylinder 114.

The present invention provides for an improved clothes bagging and hanging rack by providing for a bagging rack and a hanging rack disposed on a base, whereby a user may quickly bag a clothing item, remove the clothing item from the bagging rack, place clothing item on a hanging rack, and retrieve another clothing item from the hanging rack to be bagged. Moreover, the present invention provides for the bagging and hanging of clothing items on a secure base structure, having a box holding wire to make it easier for the user to retrieve a clothing bag, while the clothing items are safely hung on the hanging rack and the bagging rack.

The invention is not limited to the particular details of the apparatus depicted and other modifications and applications may be contemplated. Certain other changes may be made in the above-described apparatus without departing from the true spirit and scope of the invention here involved, for example, the cross bar on the hanging rack may be positioned to extend parallel with the back edge of the base instead of extending in a plane towards, and away from, the bagging rack. It is intended, therefore, that the subject matter of the above depiction shall be interpreted as illustrative and not in a limiting sense.

What is claimed is:

1. An apparatus comprising:

a base having a front edge and a back edge;

a bagging rack having a foot pedal, the foot pedal coupled to the front edge of the base, wherein the bagging rack is extendable;

a hanging rack coupled to the back edge of the base, wherein the hanging rack is adjustable;

a crossbar disposed on the hanging rack, extending perpendicularly from the hanging rack, parallel with the base, the crossbar having a first end disposed in the direction of the bagging rack and a second end disposed away from the bagging rack; and a box holding wire coupled to the base disposed substantially between the bagging rack and the hanging rack.

2. The apparatus of claim 1 wherein the bagging rack further includes a bagging rack lower cylinder and a bagging rack upper tube wherein the bagging rack upper tube is extendable relative to the bagging rack lower cylinder.

3. The apparatus of claim 2 wherein the bagging rack is extendable to a first operative position and retractable to a second operative position.

4. The apparatus of claim 3 wherein the bagging rack upper tube can be retracted from the first operative position to the second operative position upon depression of the foot pedal.

5. The apparatus of claim 1 wherein the hanging rack comprises a hanging rack lower cylinder and a hanging rack upper tube wherein the position of the hanging rack upper tube relative to the hanging rack lower cylinder is adjustable.

6. The apparatus of claim 5 wherein the hanging rack further comprises a load spring disposed within the hanging rack upper tube, the load spring having an outer tab, wherein the hanging rack upper tube is disposed relative to the hanging rack lower cylinder by way of the outer tab of the load spring engaging with one of a plurality of apertures disposed on the hanging rack lower cylinder.

7. The apparatus of claim 1 further comprising a clip disposed on the bagging rack.

8. The apparatus of claim 7 wherein the clip comprises a C-shaped hook.

9. The apparatus of claim 8 wherein the clip is disposed on top of the bagging rack.

10. The apparatus of claim 1 wherein the crossbar further includes a first disc disposed on the first end and a second disc disposed on the second end.

11. The apparatus of a claim 1 further comprising a plurality of bumpers disposed on the underside of the base.

12. An apparatus comprising:

a base having a front edge and a back edge;

a bagging rack operably coupled to the base, the bagging rack having a bagging rack lower cylinder and a bagging rack upper tube wherein the bagging rack upper tube is extendable relative to the bagging rack lower cylinder;

a foot pedal coupled to the front edge of the base and the bagging rack;

a hanging rack coupled to the back edge of the base, the hanging rack having a hanging rack lower cylinder and a hanging rack upper tube wherein the position of the hanging rack upper tube relative to the hanging rack lower cylinder is adjustable;

a crossbar disposed on the hanging rack, extending perpendicularly from the hanging rack, parallel with the base, the crossbar having a first end disposed in the direction of the bagging rack and having a second end disposed away from the bagging rack; and a box holding wire coupled to the base disposed substantially between the bagging rack and the hanging rack.

13. The apparatus of claim 12 wherein the bagging rack is extendable to a first operative position and retractable to a second operative position.

14. The apparatus of claim 13 wherein the bagging rack upper tube can be retracted from the first operative position to the second operative position upon depression of the foot pedal.

15. The apparatus of claim 12 wherein hanging rack further comprises a load spring disposed within the hanging rack upper tube, the load spring having an outer tab, wherein the hanging rack upper tube is disposed relative to the hanging rack lower cylinder by way the outer tab of the load spring engaging with one of a plurality of apertures disposed on the hanging rack lower cylinder.

16. The apparatus of claim 12 further comprising a clip having a C-shaped hook disposed on top of the bagging rack upper tube.

17. An apparatus comprising:

a base having a front edge and a back edge;

a bagging rack operably coupled to the base, the bagging rack having a bagging rack lower cylinder and a bagging rack upper tube wherein the bagging rack upper tube is extendable relative to the bagging rack lower cylinder, wherein the bagging rack is extendable to a first operative position and retractable to a second operative position;

a clip having a C-shaped hook disposed on top of the bagging rack upper tube;

a foot pedal coupled to the front edge of the base and the bagging rack, wherein the bagging rack upper tube can be retracted from the first operative position to the second operative position upon depression of the foot pedal;

a hanging rack coupled to the back edge of the base, the hanging rack having a hanging rack lower cylinder and a hanging rack upper tube wherein the position of the hanging rack upper tube relative to the hanging rack lower cylinder is adjustable, wherein the hanging rack contains a load spring disposed within the hanging rack upper tube, the load spring having an outer tab, wherein the hanging rack upper tube is disposed relative to the hanging rack lower cylinder by way of the outer tab of the load spring engaging with one of a plurality of apertures disposed on the hanging rack lower cylinder;

a crossbar disposed on the hanging rack, extending perpendicularly from the hanging rack, parallel with the base, the crossbar having a first end disposed in the direction of the bagging rack and having a second end disposed away from the bagging rack; and a box holding wire coupled to the base disposed substantially between the bagging rack and the hanging rack.

* * * * *